US006152179A

United States Patent [19]

Büttner et al.

[11] Patent Number: 6,152,179

[45] Date of Patent: Nov. 28, 2000

[54] MANUALLY OPERABLE HYDRAULIC PILOT CONTROL

[75] Inventors: Peter Büttner, Lohr/Main; Lucia Jelitte, Neuendorf; Konrad Stahl, Lohr/Main, all of Germany

[73] Assignee: Mannesmann Rexroth AG, Lohr/Main, Germany

[21] Appl. No.: 09/194,981

[22] PCT Filed: Jun. 3, 1997

[86] PCT No.: PCT/EP97/02876

§ 371 Date: Dec. 4, 1998

§ 102(e) Date: Dec. 4, 1998

[87] PCT Pub. No.: WO97/47890

PCT Pub. Date: Dec. 18, 1997

[30] Foreign Application Priority Data

Jun. 7, 1996 [DE] Germany ..... 196 22 948

[51] Int. Cl.[7] ..... F15B 13/02

[52] U.S. Cl. ..... 137/625.68; 137/636.1

[58] Field of Search ..... 137/625.68, 636.1, 137/636.2

[56] References Cited

U.S. PATENT DOCUMENTS

| | | | |
|---|---|---|---|
| 3,599,675 | 8/1971 | Stevenpiper | 137/636.1 |
| 3,766,944 | 10/1973 | Distler | 137/636.2 X |
| 4,184,512 | 1/1980 | Pignolet | 137/625.68 X |
| 4,342,335 | 8/1982 | Reincker et al. | 137/636.2 |
| 4,819,695 | 4/1989 | Kervagoret . | |
| 5,482,085 | 1/1996 | Wasson | 137/636.1 X |

FOREIGN PATENT DOCUMENTS

| | | |
|---|---|---|
| 2621150 | 12/1976 | Germany . |
| 2751946 | 7/1978 | Germany . |
| 3321972 | 12/1983 | Germany . |
| 3635625 | 4/1988 | Germany . |
| 8806210 | 8/1988 | Germany . |
| 8716781 | 5/1989 | Germany . |
| 4011593 | 10/1991 | Germany . |
| 4207703 | 11/1992 | Germany . |
| 4333788 | 4/1994 | Germany . |

*Primary Examiner*—Gerald A. Michalsky
*Attorney, Agent, or Firm*—Martin A. Farber

[57] ABSTRACT

A manually operable hydraulic pilot-control device having a continuously adjustable pressure-reducing valve, having a housing and, in a continuous housing bore, a control piston, actable upon by a control spring in opening direction of a connection between a pressure inlet and a control outlet and is actable upon in opposite direction by pressure in the control outlet, and its control spring is restrained between a first fixed stop of the control piston and a spring retainer, placeable against a second fixed stop of the control piston and is driveable by an axially guided plunger located at a first open end of the housing bore and is supportable spaced from the second stop of the control piston. The control piston is displaceable in a control sleeve put in the housing bore, and an axial position of the control sleeve is adjustable from outside, wherein space in front of one end face of the control sleeve in which the control spring is located is connected to a tank outlet, and wherein two annular spaces are formed between the control sleeve and the housing bore wall. The annular spaces are sealed from one another at the bore wall and from the space in front of one end face of the control sleeve. One annular space is connected to the pressure inlet and the other annular space is connected to the control outlet, and from which in each case at least one radial bore leads through the control sleeve into its interior.

14 Claims, 2 Drawing Sheets

MANUALLY OPERABLE HYDRAULIC PILOT CONTROL

FIELD AND BACKGROUND OF THE INVENTION

The invention relates to a manually operable hydraulic pilot-control device.

DE 27 51 946 C2, for example, discloses a manually operable hydraulic pilot-control device. It works on the basis of continuously adjustable pressure-reducing valves, at the control outlet of which a pilot-control pressure dependent upon the deflection of a hand lever can be set. The hydraulic pilot-control device shown in the above-mentioned specification has, in a housing, a continuous housing bore, which, in the interior of the housing, has a control section, in which the control piston of a pressure-reducing valve is guided tightly in an axially displaceable manner. Bore sections of larger diameter follow on both sides of the control section. Screwed into one end of the housing bore is a guide bush, in which a plunger is guided in an axially displaceable manner, which plunger projects away from the housing beyond the guide bush and can run with a collar on its inner end against the guide bush. At its end projecting outward beyond the guide bush, the plunger can be acted upon by a hand lever via an intermediate member. On the inside, a spring retainer is pressed against the plunger by two helical compression springs. One helical compression spring is a restoring spring for the plunger and for the hand lever and is supported on a shoulder of the housing bore in addition to being supported on the spring retainer, this shoulder limiting the control section of the housing bore in the one direction, The second compression spring is the control spring of the pressure-reducing valve, and this control spring is supported on a shoulder of the control piston in addition to being supported on the spring retainer and can thus act upon the control piston in a direction away from the plunger. The control piston extends with a long neck through the control spring and, by means of a head, engages behind the spring retainer at the plunger. When the head bears against the spring retainer, there is a clearance space between the head and the plunger in the axial direction, and this clearance space permits a relative displacement between control piston and plunger.

The control piston is a hollow piston having an axial blind bore, which, at the control-piston end face remote from the plunger, is open toward a housing-bore section which is designed as a screw connection and constitutes the control outlet of the pressure-reducing valve. Running between the blind bore and the outside of the control piston are a plurality of radial bores, via which, as a function of the position of the control piston, the space in which the restoring spring and the control spring are located and which is connected to a tank outlet of the pilot-control device, or a control space which is connected to the pressure inlet of the pilot-control device, can be connected to the blind bore and thus to the control outlet. The spring space, containing the restoring spring and the control spring, and the control space are separated from one another by a narrow housing web, the axial extent of which is slightly greater than the diameter of the radial bores in the control piston. The control piston is located in the control position when the radial bores are covered at least almost completely by the housing web. In this control position there is equilibrium between the axially directed forces acting upon the control piston. The force acting from the control spring in the one direction is just as large as the opposing force produced by the pressure at the control outlet on the cross-sectional area of the control piston. Small movements of the control piston out of the control position connect the blind bore and thus the control outlet to the tank outlet or the pressure inlet, as a result of which the pressure in the control outlet is kept largely constant in a certain position of the plunger.

In the zero position of the hand lever and the plunger, the radial bores in the control piston are at a distance from the control space connected to the pressure inlet. The control spring is restrained between the control piston and the plunger with a certain preloading force.

With the known pilot-control device, a pilot-control pressure according to the control curve shown in FIG. 2 can be set as a function of the deflection of the hand lever or as a function of the stroke of the plunger. At the start of a movement of the hand lever out of the zero position, the control piston is driven along by the plunger via the control spring and the spring retainer at the plunger, without a pressure first building up in the control outlet. This idle travel is determined by the initial distance between the radial bores in the control piston and the control space connected to the pressure inlet of the pilot-control device. As soon as a cross section of flow is opened between the radial bores and the control space, the control pressure jumps to a value which is determined by the preloading force of the control spring in the zero position. Upon further deflection of the hand lever and further displacement of the plunger, the control spring is compressed further, while the control piston remains in the region of its control position or returns into its control position after the build-up of the corresponding pressure in the control outlet. In accordance with the linear characteristic of the control spring, the control pressure increases linearly with the plunger stroke.

In some applications it is desired that the idle travel and the extent of the initial jump in the pilot-control pressure correspond to very accurately determined values. This is the case, for example, in vehicles which are equipped with separate hydrostatic drives for the two sides of the vehicle, for example for two crawler tracks, and are steered by two drive wheels on opposite sides of the vehicle being driven at different speeds. The idle travel at the pilot-control device ensures that small movements of the hand lever on the pilot-control device, which are caused by vibrations for example, do not already lead to a different speed of the drive wheels and thus to a steering deflection. On the other hand, idle travel at the pilot-control device means steering play, which is to be limited to a certain value. Both factors together lead to the demand that the idle travel is to be maintained very accurately.

It is also desirable that the extent of the pressure jump at the end of the idle travel and a response threshold of the hydraulic main device which is activated by the pilot-control device, for example the response threshold of an operating cylinder for the adjustment of a variable displacement pump, are matched to one another. If the pressure jump at the pilot-control device is lower than the threshold at the main device, the lever or plunger travel at the pilot-control device increases until the main device responds. This makes itself felt in an increase in the idle travel and, in the case of steering controlled at different speeds, in increased steering play. If the initial jump in the pressure is higher than the response threshold of the main device, the pilot control becomes less sensitive.

SUMMARY OF THE INVENTION

It is an object of the invention to develop a manually operable hydraulic pilot-control device of the introductorymentioned type, respectively, in such a way that the idle travel can be set in a simple manner.

According to the invention the control piston is displaceable in a control sleeve put into the housing bore, and in that the axial position of the control sleeve is adjustable from the second open end of the housing bore. The control edges formed on the control sleeve and interacting with the control piston can be displaced inside the housing bore and in each case brought into such a position that, by the deflection of the hand lever or by the displacement of the plunger, a cross section of flow between the control outlet and the pressure inlet is opened in each case after certain travel. The accessibility of the control sleeve from the second open end of the housing bore makes the adjustment especially simple, since it is not necessary to dismantle any parts of the pilot-control device in order to reach the control sleeve.

Another object of the invention is also to develop a manually operable hydraulic pilot-control device, in such a way that the extent of the initial jump in the control pressure can be set.

According to the invention, an adjusting spring is restrained between the control piston and an adjustable stop fixed to the housing. In principle, it is of course conceivable to change the pressure jump by adapting the minimum preloading of the control spring, this minimum preloading being present in the zero position of hand lever and plunger. This is very laborious and difficult since it involves dismantling and assembly work. In the pilot-control device according to the invention, an additional spring is now used, and this spring, in addition to being supported on the control piston, is also supported on a stop which assumes a fixed position with respect to the housing after the adjustment. In the control position, which the control piston assumes after the control pressure is regulated, this additional adjusting spring is always loaded at least approximately to the same extent, so that, with consideration of the direction of force, in each case a constant force is added to the force exerted by the control spring on the control piston. The initial jump in the control pressure can thus be increased or decreased by changing the preloading of the adjusting spring. The adjustable stop fixed to the housing can easily be arranged in such a way that it is accessible from outside. Thus an adjustment is possible in an especially simple manner.

Advantageous refinements of a manually operable hydraulic pilot-control device according to the invention provide advantageous refinements of a manually operable hydraulic pilot-control device.

Further according to features of the invention, the control sleeve can advantageously be fitted into the housing bore from the second open end of the latter. As a result, no changes at all compared with known pilot-control devices are necessary in the region of the plunger.

The control sleeve is preferably screwed into the housing and has an external polygonal profile for applying a screwdriving tool. If a restoring spring acting upon the plunger is supported on the control sleeve according to another feature of the invention, no supporting shoulder is required in the housing bore. The change in the preloading of the restoring spring with the position of the control sleeve is only slight and scarcely becomes noticeable during the actuation of the pilot-control device.

According to another feature of the invention, a shoulder is formed in the housing bore, and the control sleeve can be placed against said shoulder when being fitted into the housing. This establishes a starting point at which the distance between the control edges on control sleeve and control piston which control the cross section of flow between the pressure inlet and the control outlet is extreme and from which the distance can be set by moving back the control sleeve.

According to the invention it is specified how control oil can be fed to and discharged from the control outlet in an advantageous manner. In particular, according to features of the invention, the control outlet does not lie in the axis of the control piston, since a control line attached to the control sleeve could impair the adjustment, in particular the turning of the control sleeve.

The pilot-control device according to the invention is developed in an especially preferred manner. According to features of the invention, there is a spring space in each case on either side of a control bore in which a control section of the control piston is guided. The control spring and possibly a restoring spring acting upon the plunger are accommodated by the one, first spring space, whereas the adjusting spring is located in the other, second spring space, that is, it lies opposite the control spring relative to the control section on the control piston. The construction of the pilot-control device then becomes especially simple when the adjusting spring, according to features of the invention, acts upon the control piston as a compression spring in the opposite direction to the control spring. The force of the adjusting spring is therefore added to the pressure force opposed to the force of the control spring.

So that the same control piston provided with an axial blind bore and at least one radial bore can be used as in known pilot-control devices, the second spring space, according to features of the invention, is connected to the control outlet. This is advantageously done by a radial discharge from the second spring space, since an axial discharge and a control line attached in the axis of the control piston would hinder the adjustment of the stop for the adjusting spring.

Especially advantageous is the design of a pilot-control device according to features of the invention, according to which an adjustable stop, fixed to the housing, for the adjusting spring and a control sleeve put into the housing bore and adjustable in its axial position are combined with one another without taking up an excessive amount of space, so that the idle travel and the extent of the pressure jump can be set very accurately. In this case, first the idle travel is adjusted by displacing the control sleeve and then the preloading of the adjusting spring is adjusted by displacing the stop.

BRIEF DESCRIPTION OF THE DRAWINGS

An exemplary embodiment of a pilot-control device according to the invention and a control curve are shown in the drawings. The invention will now be explained in more detail with reference to the figures of these drawings, in which.

DETAILED DESCRIPTION OF THE PREFERRED EMBODIMENTS

Figure 1:
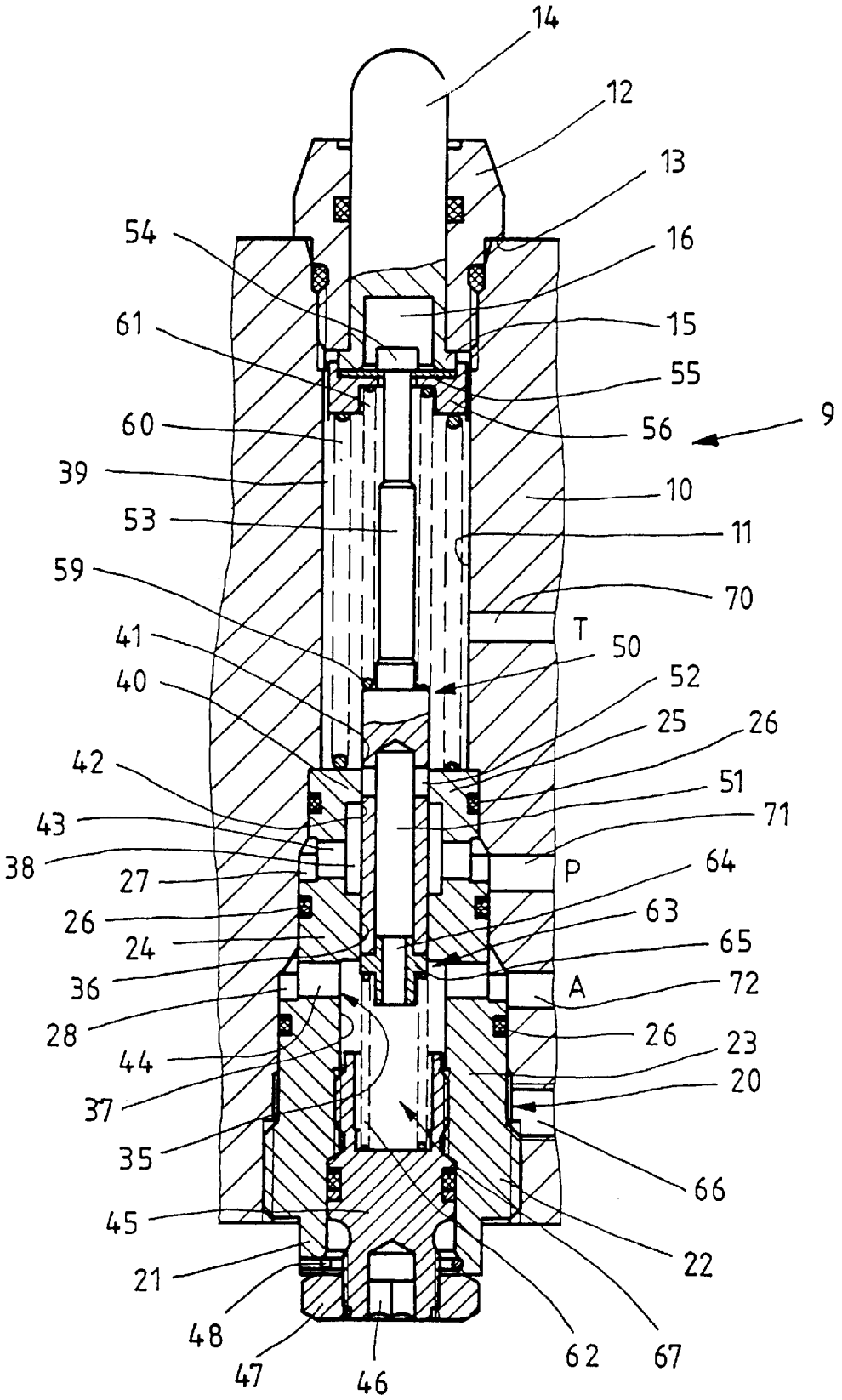
FIG. 1 shows a longitudinal section through the exemplary embodiment.

In the partial detail view according to FIG. 1, the exemplary embodiment of a pilot-control device according to the invention, which works on the basis of one or more pressure-reducing valves 9, has a housing 10 having a continuous housing bore 11 with sections of different diameter. From one end, a guide bush 12 is screwed into the housing bore 11 to such an extent that it bears with an outer shoulder 13 against the housing 10. Axially guided in the guide bush 12 is a plunger 14, which can be pressed with a collar 15 against the inwardly pointing end face of the guide bush 12 and which has a blind bore 16 which is open into the interior of the housing bore 11. When it bears with the collar 15 against the guide bush 12, the plunger 14 projects beyond the guide bush 12 by a distance which is greater than the requisite axial displacement travel. As in the known pilot-control devices, the plunger 14 can be actuated via a pivotable hand lever (not shown in any more detail).

From the other open end of the housing bore 11, a control sleeve 20, on which essentially four sections lying axially one behind the other can be distinguished on the outside, is screwed into this housing bore 11. Outside the housing bore 11, the control sleeve 20 has an external hexagonal profile 21, to which a screwdriving tool can be applied for turning the control sleeve. Following the external hexagonal profile 21 is a threaded section 22, the external thread of which engages with an internal thread in the housing bore 11. Three circular cylindrical sections 23, 24 and 25 then follow, the section 23 adjoining the threaded section 22 having the largest outside diameter, the following section 24 having a mean outside diameter and the last section 25 having the smallest outside diameter. An annular groove into which a sealing ring 26 is inserted runs on the outside around each section 23, 24 and 25. An annular space 27 is formed between the sleeve section 25 and the housing 10, and an annular space 28 is formed between the sleeve section 24 and the housing 10.

At the axial bore 35 passing through the control sleeve 20, essentially two bore sections 36 and 37, merging into one another in a stepped manner, can be distinguished from one another. The bore section 36 extends axially over the sleeve section 25 and over about two thirds of the sleeve section 24. It serves as a guide bore for the control piston 50 and as a control bore for the entire pressure-reducing valve 9 shown and controls together with the control piston 50 the connections between the various ports of the valve. It has an annular control space 38, which is separated by a web 40 of the control sleeve from a spring space 39 located in front of the sleeve section 25. The annular edges between the end faces of the web 40 and the bore section 36 form the fixed control edges 41 and 42 of the pressure-reducing valve 9. The control space 38 is connected to the annular space 27 via a plurality of radial bores 43.

The bore section 37 has a larger diameter than the bore section 36 and is connected to the annular space 28 via a plurality of radial bores. It is closed to the outside by an adjusting screw 45, which has a hexagonal socket 46, is screwed into the control sleeve 20 and is secured in its position by a lock nut 47. A retaining ring 48 inserted into the control sleeve 20 limits the adjusting travel of the adjusting screw 45 to the outside.

The control piston 50 is a hollow piston having an axial blind bore 51, which is open toward the bore section 37 of the control sleeve 20 and is connected to the outside of the control piston via a plurality of radial bores 52. The diameter of the radial bores 52 is slightly smaller than the axial distance between the two control edges 41 and 42 on the control sleeve 20, so that the radial bores can be completely covered by the web 40. The control piston 50 extends with a neck 53 through the spring space 39 and projects with a head 54 into the blind bore 16 of the plunger 14. With the head 54, it engages behind a disk 55, which is arranged between the collar 15 of the plunger 14 and a spring retainer 56 and holds the head 54 like a slotted retaining ring. A restoring spring 60 accommodated by the spring space 39 is supported on the one side on the control sleeve 20 and on the other side, via the spring retainer 56 and the disk 55, on the plunger 14, which it presses against the guide bush 12 in the neutral position of the pressure-reducing valve 9. Furthermore, a control spring 61 is accommodated by the spring space 39, and this control spring 61 is restrained between a shoulder 59 of the control piston 50 and the spring retainer 56 and ensures that the head 54 of the control piston 50 bears against the disk 55 in the neutral position of the plunger 14.

As spring space 67, the free region of the bore section 37 between the control sleeve 20 and the adjusting screw 45 accommodates an adjusting spring 62, which is restrained between the adjusting screw 45 and a spring retainer 63, which has a continuous axial bore 64, bears with a collar 65 against the control piston 50 and is guided on the one side in the control piston 50 and itself guides the adjusting spring 62.

The spring space 39 is connected to a tank outlet T via a passage 70, the annular space 27 is connected to a pressure inlet P via a passage 71, and the annular space 28 is connected to a control outlet A of the pressure-reducing valve 9 via a passage 72.

Just as the adjusting screw 45, by turning it, is axially displaceable relative to the control sleeve 20, so is the control sleeve 20 also axially displaceable relative to the housing 10. The control sleeve is locked in a certain position by a locking screw (not shown in any more detail) screwed into a radial tapped hole 66.

Figure 2:
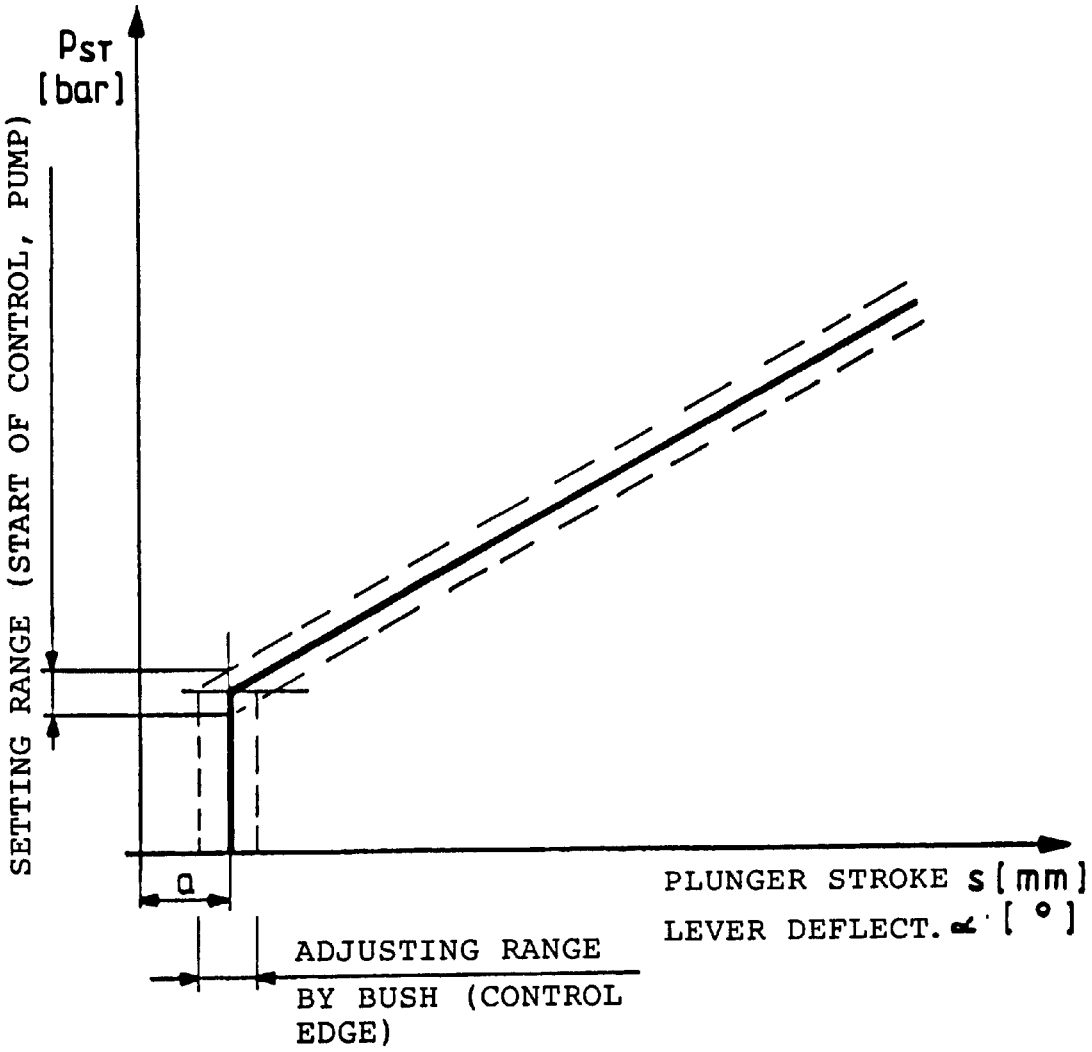
FIG. 2 shows the control curve.

In the position shown in FIG. 1, the control sleeve 20 is screwed into the housing 10 up to a stop. In this position of the control sleeve 20, the radial bores 52 are at a certain clear distance from the control edge 42. There is a small cross section of flow between the control edge 41 and the radial bores 52. The distance between the control edge 42 and the radial bores 52 allows for tolerances of the housing 10, the guide sleeve 12 and the plunger 14, the control sleeve 20 and the control piston 50. Irrespective of the tolerances, a desired distance can now be set between the control edge 42 and the radial bores 52 by turning back the control sleeve 20. It may now be assumed that a certain distance a is set and the plunger 14 is pressed down. The spring retainer 56 and, together with it, one end of the control spring 61 are driven along via the plunger 14. The control spring 61, via its other end, also pushes along the control piston 50. The connection between the pressure inlet P and the blind bore 51 of the control piston 50 via the radial bores 52 and thus the connection to the control outlet A remain closed until the plunger 14 has covered a length of travel which is equal to the distance a between the control edge 42 and the radial bores 52. The pressure in the control outlet A therefore remains at tank pressure level. Finally, a cross section of flow between the pressure inlet P and the control outlet A is opened, whereupon the pressure at the control outlet A jumps to a pressure predetermined by the preloading force of the control spring 61. By the plunger 14 being pressed down further, the control spring 61 is preloaded to an ever increasing degree with regard to the control position of the control piston 50, and the pressure in the control outlet A, in accordance with the linear characteristic of the control spring 61, increases linearly with the displacement travel of the plunger 14. The dependence described of the control pressure on the plunger stroke can clearly be seen from FIG. 2. The curve for the dependence of the control pressure on the pivoting angle of the hand lever is largely identical, provided the pivoting angle is small. In FIG. 2, the desired control curve is indicated by the continuous line. The two broken vertical lines indicate the tolerance range within which the desired control curve can still be obtained by adjusting the control sleeve 20.

After adjustment of the control sleeve 20, idle travel a up to the pressure jump clearly apparent from FIG. 2 is set. The extent of the pressure jump lies first of all somewhere within a tolerance band. If the adjusting screw 45 is now turned and axially displaced as a result, the preloading of the adjusting spring 62 in the control position of the control piston 50 is changed. Since equilibrium prevails in the control position between the force of the control spring 61 and the opposed force of the adjusting spring 62 and the likewise opposed force produced by the control pressure at the control piston, the control pressure is all the lower, the greater the preloading of the adjusting spring 62 is. The desired extent of the pressure jump after the idle travel a can therefore be set within certain limits by means of the adjusting screw 45 and the adjusting spring 62. The setting range is given in FIG. 2 by the vertical distance between the two broken lines sloping upward.

What is claimed is:

1. A manually operable hydraulic pilot-control device having a continuously adjustable pressure-reducing valve (9), which has a housing (10) and, in a continuous housing bore (11), a control piston (50), which is actable upon by a control spring (61) in an opening direction of a connection between a pressure inlet (P) and a control outlet (A) and is actable upon in the opposite direction by pressure in the control outlet (A), and the control spring (61) of which is restrained between a first fixed stop (59) of the control piston (50) and a spring retainer (56), which is placeable against a second fixed stop (54) of the control piston (50) and is driveable along by an axially guided plunger (14) located at a first open end of the housing bore (11) and is supportable at a distance from the second stop (54) of the control piston (50), wherein the control piston (50) is displaceable in a control sleeve (20) put into the housing bore (11), and wherein an axial position of the control sleeve (20) is adjustable from outside, wherein space (39) in front of one end face of the control sleeve (20) in which the control spring (61) is located is connected to a tank outlet (T), and wherein two annular spaces (27, 28) are formed between the control sleeve (20) and the wall of the housing bore (11), which annular spaces (27, 28) are sealed off from one another at the bore wall and from the space (39) in front of one end face of the control sleeve (20), and of which one annular space (27) is connected to the pressure inlet (P) and the other annular space (28) is connected to the control outlet (A), and from which in each case at least one radial bore (43, 44) leads through the control sleeve (20) into its interior.

2. The pilot-control device as claimed in claim 1, wherein the control sleeve (20) is fittable into the housing bore (11) from a second open end of the latter.

3. The pilot-control device as claimed in claim 1, wherein the control sleeve (20) is screwed into the housing (10).

4. The pilot-control device as claimed in claim 3, wherein the control sleeve (20) has an external polygonal profile (21) for applying a screwdriving tool.

5. The pilot-control device as claimed in claim 1, wherein a restoring spring (60) acts upon the plunger (14) and is supported on the control sleeve (20).

6. The pilot-control device as claimed in claim 1, wherein a shoulder is formed in the housing bore (11), and the control sleeve (20) is placeable against said shoulder when being fitted into the housing (10).

7. The pilot-control device as claimed in claim 1, wherein the axial position of the control sleeve (20) is adjustable from the second open end of the housing bore (11).

8. A manually operable hydraulic pilot-control device having a continuously adjustable pressure-reducing valve (9), which has a housing (10) and, in a continuous housing bore (11), a control piston (50), which is actable upon by a control spring (61) in an opening direction of a connection between a pressure inlet (P) and a control outlet (A) and is actable upon in the opposite direction by pressure in the control outlet (A), and the control spring (61) of which is restrained between a first fixed stop (59) of the control piston (50) and a spring retainer (56), which is placeable against a second fixed stop (54) of the control piston (50) and is driveable along by an axially guided plunger (14) located at a first open end of the housing bore (11) and is supportable at a distance from the second stop (54) of the control piston (50), wherein an adjusting spring (62) is arranged between the control piston (50) and an adjustable stop (45) fixed to the housing, wherein a control sleeve (20) is put into the housing bore (11) from the second open end, in which control sleeve (20) the control piston (50) is displaceable and its axial position is adjustable, and wherein the adjustable stop (45), fixed to the housing, for the adjusting spring (62) sits in the control sleeve (20) and is axially adjustable from outside relative to the control sleeve (20).

9. The pilot-control device as claimed in claim 8, wherein the adjustable stop fixed to the housing is formed by an adjusting screw (45).

10. The pilot-control device as claimed in claim 9, wherein the travel of the adjusting screw (45) to the outside is limited by a retaining stop (48).

11. The pilot-control device as claimed in claim 8, wherein there is a spring space (39, 67) in each case on either side of a control bore (36) in which a control section of the control piston (50) is guided, and wherein at least one of the control spring (61) and a restoring spring (60) acting upon the plunger (14) is accommodated by the one, first spring space (39), and the adjusting spring (62) is accommodated by the other, second spring space (67).

12. The pilot-control device as claimed in claim 11, wherein the adjusting spring (62) acts upon the control piston (50) as a compression spring in the opposite direction to the control spring (61).

13. A manually operable hydraulic pilot-control device having a continuously adjustable pressure-reducing valve (9), which has a housing (10) and, in a continuous housing bore (11), a control piston (50), which is actable upon by a control spring (61) in an opening direction of a connection between a pressure inlet (P) and a control outlet (A) and is actable upon in the opposite direction by pressure in the control outlet (A), and the control spring (61) of which is restrained between a first fixed stop (59) of the control piston (50) and a spring retainer (56), which is placeable against a second fixed stop (54) of the control piston (50) and is driveable along by an axially guided plunger (14) located at a first open end of the housing bore (11) and is supportable at a distance from the second stop (54) of the control piston (50), wherein an adjusting spring (62) is arranged between the control piston (50) and an adjustable stop (45) fixed to the housing, wherein there is a spring space (39, 67) in each case on either side of a control bore (36) in which a control section of the control piston (50) is guided, and wherein at least one of the control spring (61) and a restoring spring (60) acting upon the plunger (14) is accommodated by the one, first spring space (39), and the adjusting spring (62) is accommodated by the other, second spring space (67), wherein the adjusting spring (62) acts upon the control piston (50) as a compression spring in the opposite direction to the control spring (61), and wherein the control piston (50) is a hollow piston provided with an axial blind bore (51), wherein the blind bore (51) is connectable to the pressure inlet (P) via at least one radial bore (52) and opens toward the second spring space (67), and wherein the second spring space (67) is connected to the control outlet (A).

14. The pilot-control device as claimed in claim 13, wherein arranged between the control piston (50) and the adjusting spring (62) is a collar bush (63), which bears with one side of its collar (65) against the control piston (50) and supports the adjusting spring (62) with the other side of its collar (65) and which engages in the control piston (50) with a first centering peg and in the adjusting spring (62) with a second centering peg.

* * * * *